US009385510B2

(12) United States Patent
Deguchi et al.

(10) Patent No.: US 9,385,510 B2
(45) Date of Patent: Jul. 5, 2016

(54) SPARK PLUG FOR INTERNAL COMBUSTION ENGINE AND METHOD OF MANUFACTURING SPARK PLUG

(71) Applicant: DENSO CORPORATION, Kariya, Aichi-pref. (JP)

(72) Inventors: Masataka Deguchi, Obu (JP); Hironori Osamura, Chiryu (JP); Kanechiyo Terada, Handa (JP); Junichi Wada, Aichi-ken (JP); Masamichi Shibata, Toyota (JP); Yuuki Tsukamoto, Toki (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/842,073

(22) Filed: Sep. 1, 2015

(65) Prior Publication Data

US 2016/0064903 A1 Mar. 3, 2016

(30) Foreign Application Priority Data

Sep. 1, 2014 (JP) ..... 2014-177059
Sep. 1, 2014 (JP) ..... 2014-177060

(51) Int. Cl.

| | |
|---|---|
| ***H01T 13/20*** | (2006.01) |
| ***H01T 13/32*** | (2006.01) |
| ***H01T 21/02*** | (2006.01) |
| ***H01T 13/34*** | (2006.01) |

(52) U.S. Cl.
CPC ..... *H01T 13/32* (2013.01); *H01T 13/34* (2013.01); *H01T 21/02* (2013.01)

(58) Field of Classification Search
CPC ..... H01T 13/20; H01T 13/32; H01T 13/34; H01T 21/02
USPC ..... 313/120, 135, 141, 144
See application file for complete search history.

(56) References Cited

U.S. PATENT DOCUMENTS

| | | | | |
|---|---|---|---|---|
| 2,586,864 | A | 2/1952 | Rose | |
| 5,557,158 | A * | 9/1996 | Kanao | H01T 21/02 313/139 |
| 6,628,050 | B1 * | 9/2003 | Kameda | H01T 13/20 313/141 |
| 2002/0055318 | A1 | 5/2002 | Ishiguro et al. | |
| 2005/0215160 | A1 * | 9/2005 | Kolp | H01T 21/02 445/7 |
| 2007/0069618 | A1 | 3/2007 | Havard et al. | |

FOREIGN PATENT DOCUMENTS

| | | |
|---|---|---|
| JP | 2002-141154 | 5/2002 |
| JP | 5075127 | 11/2012 |

* cited by examiner

*Primary Examiner* — Vip Patel
(74) *Attorney, Agent, or Firm* — Nixon & Vanderhye P.C.

(57) ABSTRACT

A spark plug includes a tubular housing, a tubular insulator retained in the housing, a center electrode secured in the insulator with a distal end portion of the center electrode protruding outside the insulator, and an annular ground electrode fixed to a distal end of the housing. The housing has, at the distal end thereof, a small-inner diameter portion that has a smaller inner diameter than other portions of the housing. The annular ground electrode is arranged on a distal end surface of the small-inner diameter portion of the housing so that an inner circumferential surface of the ground electrode faces an outer circumferential surface of the distal end portion of the center electrode through a spark gap formed therebetween. The outer diameter of the ground electrode is less than the outer diameter of the distal end surface of the small-inner diameter portion of the housing.

16 Claims, 11 Drawing Sheets

SPARK PLUG FOR INTERNAL COMBUSTION ENGINE AND METHOD OF MANUFACTURING SPARK PLUG

CROSS-REFERENCE TO RELATED APPLICATIONS

This application is based on and claims priority from Japanese Patent Application No. 2014-177059 filed on Sep. 1, 2014 and Japanese Patent Application No. 2014-177060 filed on Sep. 1, 2014, the contents of which are hereby incorporated by reference in their entireties into this application.

BACKGROUND

1. Technical Field

The present invention relates to spark plugs for internal combustion engines which have an annular ground electrode arranged so as to face an outer circumferential surface of a center electrode, and to methods of manufacturing the spark plugs.

2. Description of the Related Art

Japanese Patent No. 5075127 discloses a spark plug for an internal combustion engine of a motor vehicle or a cogeneration system. The spark plug has an annular ground electrode arranged so as to face an outer circumferential surface of a center electrode. The ground electrode is fixed to a housing (or metal shell) by a crimped portion of the housing; the crimped portion is crimped at a distal end of the housing against an outer periphery of the ground electrode. Between the outer circumferential surface of the center electrode and an inner circumferential surface of the annular ground electrode, there is formed an annular spark gap.

However, with the above configuration, the ground electrode is in contact with the housing on the outer periphery of the ground electrode. Therefore, the heat dissipation path from the inner circumferential surface of the ground electrode, which faces the spark gap, to the housing is long, causing the temperature of the ground electrode to be easily increased. Further, with increase in the temperature of the ground electrode, the amount of wear of the ground electrode at the spark gap is increased, thereby accelerating increase in the radial width of the spark gap. Consequently, the time needed for the radial width of the spark gap to reach an upper limit is shortened; when the radial width of the spark gap is above the upper limit, the spark plug cannot normally function. As a result, it is difficult to secure a long service life of the spark plug.

Moreover, with the above configuration, the ground electrode is disposed inside the housing and the spark gap is formed on the proximal side of the distal end of the housing. Therefore, there is a problem that it is difficult for the flame produced by a spark discharge in the spark gap to grow. That is, there is a problem that the flame makes contact with the housing and thus loses heat to the housing. Consequently, it is difficult to secure a high ignition capability of the spark plug (i.e., a high capability of the spark plug to ignite an air-fuel mixture in a combustion chamber of the engine).

Furthermore, with the above configuration, since the ground electrode is fixed inside the housing by the crimped portion of the housing, it is difficult to adjust the relative position of the ground electrode to the center electrode and thus difficult to adjust the spark gap.

More specifically, to accurately form the spark gap between the outer circumferential surface of the center electrode and the inner circumferential surface of the ground electrode, it is necessary to accurately position the ground electrode with respect to the center electrode. However, due to dimensional and assembly variations in the components of the spark plug (e.g., the housing), it is impossible to accurately form the spark gap only by accurately arranging the ground electrode at a predetermined position with respect to the housing. Therefore, it is necessary to adjust the relative position of the ground electrode to the center electrode. However, since the ground electrode is fixed inside the housing by the crimped portion, the ground electrode is restricted from being moved in a radial direction of the spark plug, thereby making it difficult to adjust the spark gap.

SUMMARY

According to exemplary embodiments, there is provided a spark plug for an internal combustion engine. The spark plug includes: a tubular housing; a tubular insulator retained in the housing; a center electrode secured in the insulator with a distal end portion of the center electrode protruding outside the insulator; and an annular ground electrode fixed to a distal end of the housing. The housing has, at the distal end thereof, a small-inner diameter portion that has a smaller inner diameter than other portions of the housing. The ground electrode is arranged on a distal end surface of the small-inner diameter portion of the housing so that: the ground electrode protrudes distalward from the distal end surface of the small-inner diameter portion of the housing; and an inner circumferential surface of the ground electrode faces an outer circumferential surface of the distal end portion of the center electrode through a spark gap formed therebetween. The outer diameter of the ground electrode is less than the outer diameter of the distal end surface of the small-inner diameter portion of the housing.

With the above configuration, the ground electrode and the housing face and abut each other in an axial direction of the spark plug. Consequently, it becomes possible to secure a large contact area between the ground electrode and the housing and shorten the heat dissipation path from the inner circumferential surface of the ground electrode, which faces the spark gap, to the housing. As a result, it becomes possible to effectively dissipate heat from the ground electrode to the housing, thereby suppressing increase in the temperature of the ground electrode. Further, with the suppression of increase in the temperature of the ground electrode, it becomes possible to suppress the wear of the ground electrode at the inner circumferential surface thereof, thereby suppressing increase in the radial width of the spark gap and thus extending the service life of the spark plug.

Moreover, with the above configuration, the spark gap is located distalward from the distal end of the housing. Consequently, it becomes possible to prevent, during the growth of the flame produced by a spark discharge in the spark gap, the flame from making contact with the housing and thus from loosing heat to the housing. As a result, it becomes possible to facilitate the growth of the flame, thereby improving the ignition capability of the spark plug.

Furthermore, with the above configuration, in joining the ground electrode to the housing, it is possible to easily adjust the relative position of the ground electrode to the center electrode by sliding the ground electrode on the distal end surface of the small-inner diameter portion of the housing. As a result, it is possible to easily adjust the spark gap even when there are dimensional and assembly variations in the components of the spark plug.

Preferably, a distal end surface of the ground electrode is located distalward from a distal end surface of the center electrode. More preferably, the distal end surface of the ground electrode is located distalward from the distal end surface of the center electrode by 0.1 to 0.3 mm and distalward from the distal end surface of the small-inner diameter portion of the housing by 0.8 to 3 mm.

It is preferable that the inner diameter of the ground electrode is less than the inner diameter of the small-inner diameter portion of the housing.

The ground electrode may include an annular base member and a noble metal layer provided on an inner circumferential surface of the base member. In this case, it is preferable that the noble metal layer is diffusion-bonded to the base member of the ground electrode.

Preferably, the ground electrode has at least one groove that is formed in the inner circumferential surface of the ground electrode along an axial direction of the spark plug.

In a further implementation, the housing has an inner shoulder formed on an inner periphery thereof, and the insulator has an outer shoulder formed on an outer periphery thereof. The insulator is retained in the housing with the outer shoulder of the insulator engaging with the inner shoulder of the housing in the axial direction of the spark plug. The housing also has a reduced-inner diameter portion which extends from the inner shoulder to the small-inner diameter portion of the housing and whose inner diameter is reduced in the distalward direction. The insulator also has a reduced-outer diameter portion which extends from the outer shoulder to a distal end of the insulator and whose outer diameter is reduced in the distalward direction.

Preferably, both the reduced-inner diameter portion of the housing and the reduced-outer diameter portion of the insulator are tapered distalward.

It is preferable that the outer diameter of the ground electrode is greater than an inner diameter of the reduced-inner diameter portion of the housing at a distal end of the reduced-inner diameter portion.

It is further preferable that the difference between the outer diameter of the ground electrode and the inner diameter of the reduced-inner diameter portion of the housing at the distal end of the reduced-inner diameter portion is less than or equal to 7 mm.

Preferably, at least one ventilation path is provided between the ground electrode and the small-inner diameter portion of the housing so as to fluidically connect the internal space of the ground electrode to the external space of the ground electrode. In this case, the ventilation path may be constituted of a ventilation groove that is: formed in the distal end surface of the small-inner diameter portion of the housing so as to extend from an inner circumferential edge of the distal end surface of the small-inner diameter portion radially outward beyond a radially outer periphery of the ground electrode; and partially covered by the ground electrode from the distal side.

According to the exemplary embodiments, there is also provided a method of manufacturing the above-described spark plug. The method includes the steps of: (1) assembling the insulator and the center electrode into the housing so that the distal end portion of the center electrode extends through an internal space of the small-inner diameter portion of the housing; and (2) joining the ground electrode to the distal end surface of the small-inner diameter portion of the housing. Moreover, in the joining step, the spark gap between the inner circumferential surface of the ground electrode and the outer circumferential surface of the distal end portion of the center electrode is adjusted and then the ground electrode is joined to the distal end surface of the small-inner diameter portion of the housing.

With the above method, the adjustment of the spark gap can be completed by the time point at which the ground electrode is joined to the distal end surface of the small-inner diameter portion of the housing. Consequently, it is possible to easily obtain the spark plug where the spark gap is accurately formed between the inner circumferential surface of the ground electrode and the outer circumferential surface of the distal end portion of the center electrode.

BRIEF DESCRIPTION OF THE DRAWINGS

The present invention will be understood more fully from the detailed description given hereinafter and from the accompanying drawings of exemplary embodiments, which, however, should not be taken to limit the invention to the specific embodiments but are for the purpose of explanation and understanding only.

In the accompanying drawings.

DESCRIPTION OF EMBODIMENTS

Figure 1:
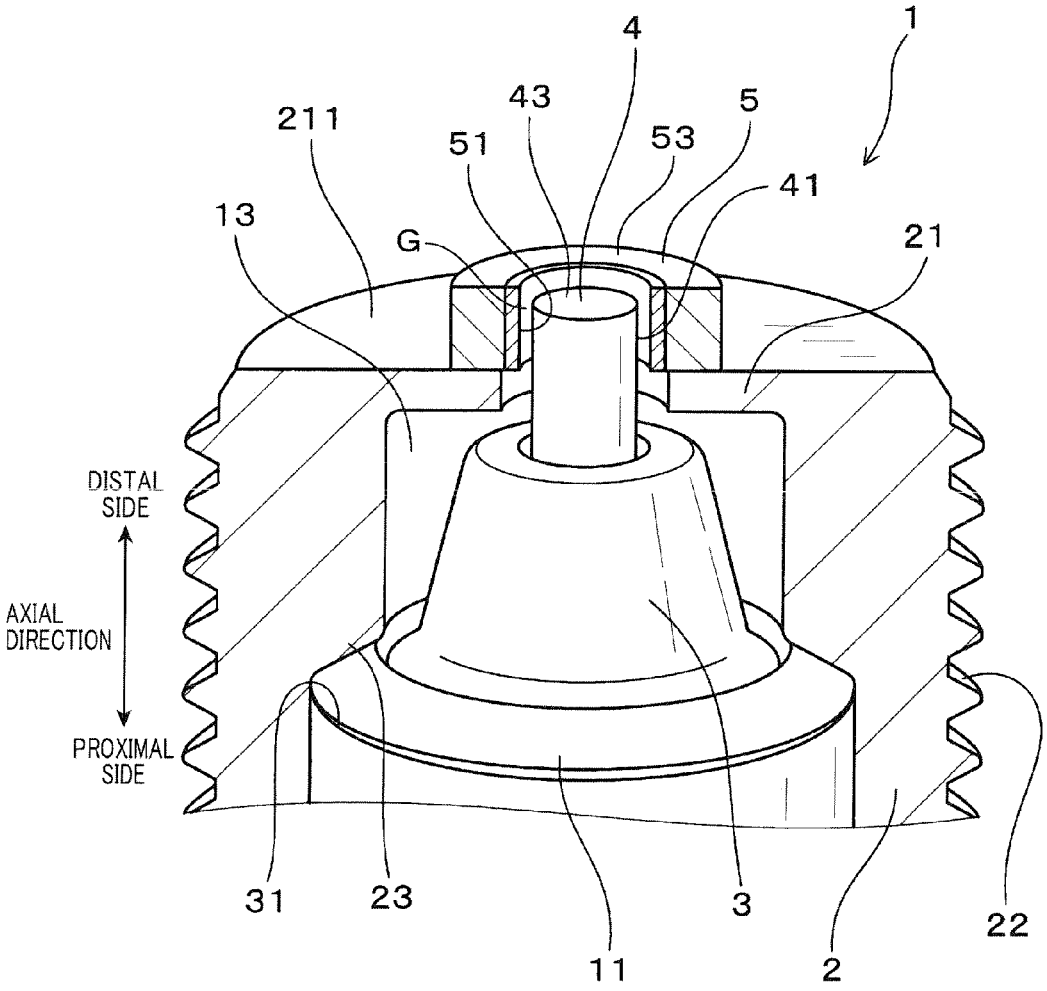
FIG. 1 is a schematic perspective view of a distal part of a spark plug according to a first embodiment.

Exemplary embodiments will be described hereinafter with reference to FIGS. 1-16. It should be noted that for the sake of clarity and ease of understanding, identical components having identical functions throughout the whole description have been marked, where possible, with the same reference numerals in each of the figures.

First Embodiment

This embodiment illustrates a spark plug 1 that is designed to be used as ignition means in an internal combustion engine of, for example, a motor vehicle or a cogeneration system.

Figure 2:
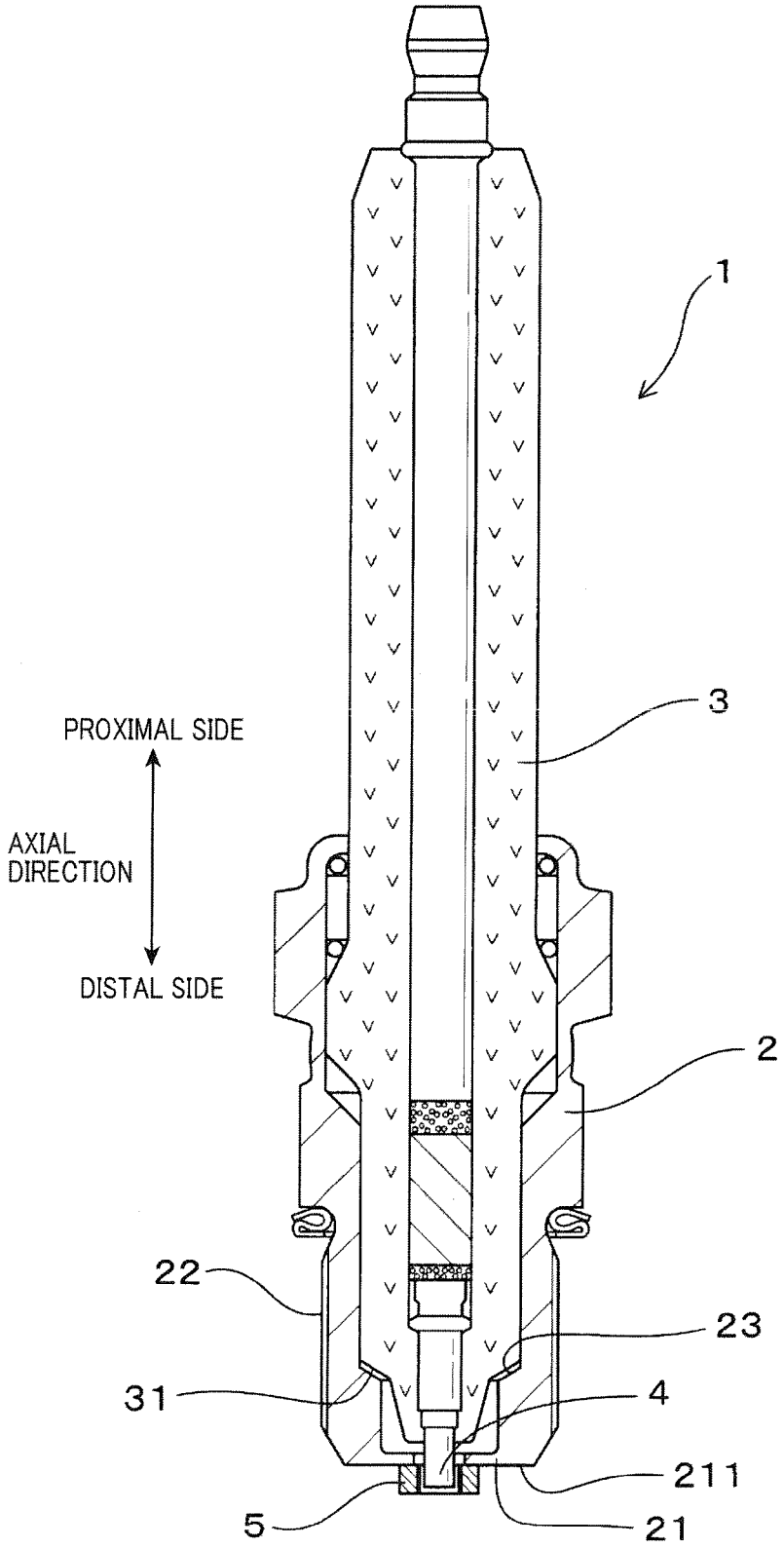
FIG. 2 is a cross-sectional view of the spark plug according to the first embodiment.

More specifically, the spark plug 1 is designed to ignite an air-fuel mixture in a combustion chamber of the engine. The spark plug 1 has one axial end to be connected to an ignition coil (not shown) and the other axial end to be placed inside the combustion chamber. In addition, hereinafter, as shown in FIGS. 1-2, the axial side where the spark plug 1 is to be connected to the ignition coil will be referred to as "proximal side"; and the other axial side where the spark plug 1 is to be placed inside the combustion chamber will be referred to as "distal side".

As shown in FIGS. 1-4, the spark plug 1 according to the present embodiment includes: a tubular housing (or metal shell) 2; a tubular insulator 3 retained in the housing 2; a center electrode 4 secured in the insulator 3 such that a distal end portion of the center electrode 4 protrudes outside the insulator 3; and an annular ground electrode 5 fixed to a distal end surface of the housing 2 so as to surround the distal end portion of the center electrode 4.

The housing 2 has a small-inner diameter portion 21 at a distal end thereof. The small-inner diameter portion 21 has a smaller inner diameter D4 than other portions of the housing 2. In addition, the small-inner diameter portion 21 has a distal end surface 211 which defines the distal end surface of the housing 2. In other words, the distal end surface 211 is located most distalward (i.e., toward the distal side) in the housing 2.

In the present embodiment, the center electrode 4 has a substantially cylindrical shape and is coaxially arranged with the tubular (or substantially hollow cylindrical) housing 2, the tubular (or substantially hollow cylindrical) insulator 3 and the annular (or substantially hollow cylindrical) ground electrode 5.

As shown in FIG. 1, the distal end surface 211 of the housing 2 is flat in shape and arranged perpendicular to the axial direction of the spark plug 1. The ground electrode 5 has a proximal end surface 52 and a distal end surface 53, both of which are flat in shape. The ground electrode 5 is joined to the housing 2 with the proximal end surface 52 of the ground electrode 5 and the distal end surface 211 of the housing 2 in surface contact with each other.

The ground electrode 5 is arranged on the distal end surface 211 of the small-inner diameter portion 21 of the housing 2 so that: the ground electrode 5 protrudes distalward from the distal end surface 211; and an inner circumferential surface 51 of the ground electrode 5 faces an outer circumferential surface 41 of the distal end portion of the center electrode 4 through an annular spark gap G formed therebetween.

Figure 4:
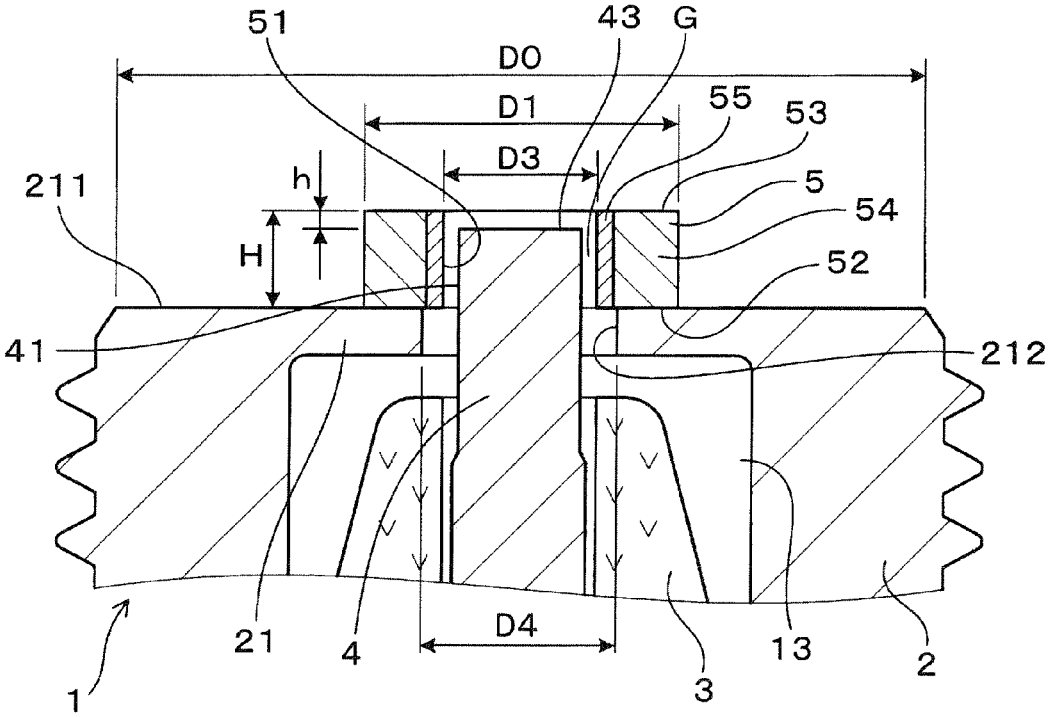
FIG. 4 is a schematic cross-sectional view of the distal part of the spark plug according to the first embodiment.

Moreover, as shown in FIG. 4, the ground electrode 5 has an outer diameter D1 that is less than an outer diameter D0 of the distal end surface 211 of the small-inner diameter portion 21 of the housing 2. Preferably, the outer diameter D1 is in the range of 5 to 10 mm while the outer diameter D0 is in the range of 12 to 22 mm. More preferably, the outer diameter D1 is in the range of 5 to 7 mm while the outer diameter D0 is in the range of 14 to 22 mm.

Since the ground electrode 5, whose outer diameter D1 is less than the outer diameter D0 of the distal end surface 211 of the small-inner diameter portion 21 of the housing 2, is joined to the distal end surface 211, the ground electrode 5 and the housing 2 face and abut each other in the axial direction of the spark plug 1. Consequently, it becomes possible to shorten the heat dissipation path from the inner circumferential surface 51 of the ground electrode 5, which faces the spark gap G, to the housing 2, thereby suppressing increase in the temperature of the ground electrode 5.

The spark gap G, which is formed between the inner circumferential surface 51 of the ground electrode 5 and the outer circumferential surface 41 of the distal end portion of the center electrode 4, is located distalward from the distal end surface 211 of the small-inner diameter portion 21 of the housing 2. Therefore, the housing 2 is not present in the direction of growth of the flame produced by a spark discharge in the spark gap G. Consequently, it becomes possible to prevent growth of the flame from being hindered by the housing 2. That is, it becomes possible to prevent the flame from making contact with the housing 2 and thus from loosing heat to the housing 2. As a result, it becomes possible to secure a high ignition capability of the spark plug 1 (i.e., high capability of the spark plug 1 to ignite the air-fuel mixture in the combustion chamber of the engine).

As shown in FIG. 4, the ground electrode 5 has its distal end surface 53 located distalward from a distal end surface 43 of the center electrode 4. It is preferable that the distal end surface 53 of the ground electrode 5 is located distalward from the distal end surface 43 of the center electrode 4 by 0.1 to 0.3 mm and distalward from the distal end surface 211 of the small-inner diameter portion 21 of the housing 2 by 0.8 to 3 mm. In other words, it is preferable that the axial distance (i.e., the distance in the axial direction of the spark plug 1) h between the distal end surface 43 of the center electrode 4 and the distal end surface 53 of the ground electrode 5 is in the range of 0.1 to 0.3 mm and the axial height (i.e., the height in the axial direction of the spark plug 1) H of the ground electrode 5 is in the range of 0.8 to 3 mm.

With the above configuration, it is possible to effectively enhance the electric field strength in the vicinity of the outer circumferential surface 41 of the distal end portion of the center electrode 4.

More specifically, upon application of a voltage between the ground electrode 5 and the center electrode 4, electric field is created in the spark gap G formed between the inner circumferential surface 51 of the ground electrode 5 and the outer circumferential surface 41 of the distal end portion of the center electrode 4. With the ground electrode 5 protruding more distalward than the center electrode 4, it becomes easy for the electric field to concentrate on the outer circumferential surface 41 of the distal end portion of the center electrode 4. Consequently, it becomes easy for electrons to be emitted from the center electrode 4, thereby lowering the required voltage of the spark plug 1 for discharging a spark across the spark gap G.

With the axial height H of the ground electrode 5 set to be greater than or equal to 0.8 mm, it is possible to improve the effect of the electric field concentration on the outer circumferential surface 41 of the distal end portion of the center electrode 4. Moreover, it is also possible to secure the wear resistance of the inner circumferential surface 51 of the ground electrode 5, thereby extending the service life of the spark plug 1. On the other hand, with the axial height H of the ground electrode 5 set to be less than or equal to 3 mm, when a spark discharge takes place in the vicinity of the proximal end of the spark gap G, it is still possible to prevent a misfire from occurring due to the loss of heat of the flame produced by the spark discharge, thereby securing the ignition capability of the spark plug 1. Moreover, it is also possible to allow the air-fuel mixture to smoothly flow into and out of the internal space 13 of the housing 2 via the spark gap G. Consequently, it is possible to sufficiently introduce the air-fuel mixture to the spark gap G, thereby more reliably securing the ignition capability of the spark plug 1.

The ground electrode 5 has an inner diameter D3 that is less than the inner diameter D4 of the small-inner diameter portion 21 of the housing 2. In the present embodiment, the inner diameter D3 is in the range of 2.8 to 3.4 mm while the inner diameter D4 is in the range of 3.6 to 4.0 mm. Consequently, it is possible to easily adjust the spark gap G by radially moving the ground electrode 5. In particular, it is possible to prevent an inner circumferential surface 212 of the small-inner diameter portion 21 of the housing 2 from being located radially inside the inner circumferential surface 51 of the ground electrode 5 even when there are dimensional and assembly variations in the components of the spark plug 1. Moreover, the inner circumferential surface 51 of the ground electrode 5 protrudes, over the entire circumference thereof, radially inward from the inner circumferential surface 212 of the small-inner diameter portion 21 of the housing 2, thereby making the radial width of the spark gap G constant over the entire circumference.

Figure 3:
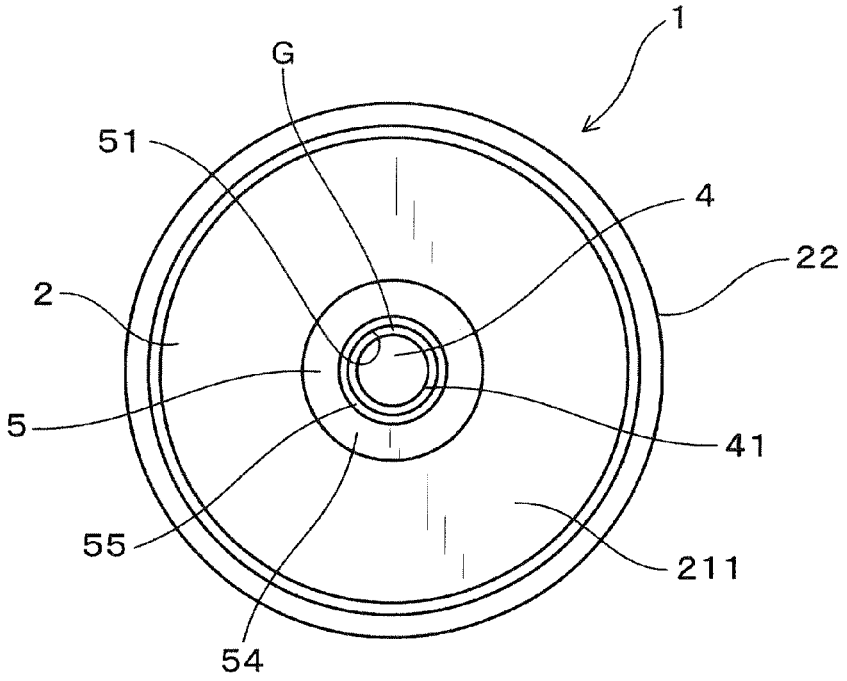
FIG. 3 is a plan view, from the distal side, of the spark plug according to the first embodiment.

More specifically, as shown in FIGS. 1 and 4, the inner circumferential surface 51 of the ground electrode 5 extends parallel to the outer circumferential surface 41 of the distal end portion of the center electrode 4. Moreover, as shown in FIG. 3, the radial width of the spark gap G formed between the inner circumferential surface 51 of the ground electrode 5 and the outer circumferential surface 41 of the distal end portion of the center electrode 4 is constant in the circumferential direction of the spark plug 1. In other words, the spark gap G is formed over the entire circumference of the inner circumferential surface 51 of the ground electrode 5 so as to have a constant radial width over the entire circumference. Consequently, it is possible to realize a stable spark discharge in the spark gap G.

Figure 5A:
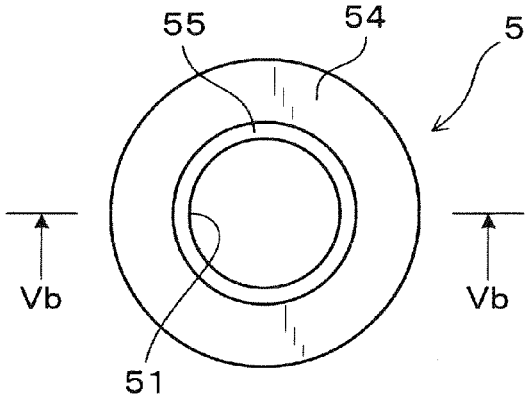
FIG. 5A is a plan view of a ground electrode of the spark plug according to the first embodiment.
Figure 5B:
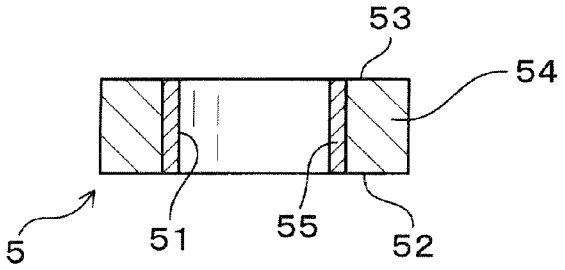
FIG. 5B is a cross-sectional view of the ground electrode taken as indicated by the arrows Vb in FIG. 5A.

In the present embodiment, as shown in FIGS. 4 and 5A-5B, the ground electrode 5 includes an annular base member 54 and a noble metal layer 55 provided on an inner circumferential surface of the base member 54. The base member 54 is made, for example, of a nickel (Ni) alloy. The noble metal layer 55 is made, for example, of platinum (Pt), iridium (Ir) or an alloy thereof. Moreover, the noble metal layer 55 is diffusion-bonded to the base member 54. The thickness of the noble metal layer 55 is set to be in the range of, for example, 0.1 to 0.5 mm.

With the above two-part formation of the ground electrode 5, it is possible to improve the wear resistance of the ground electrode 5, thereby effectively extending the service life of the spark plug 1.

Moreover, by diffusion-bonding the noble metal layer 55 to the base member 54, it is possible to secure the adhesion strength of the noble metal layer 55 to the base member 54 while enhancing heat dissipation from the noble metal layer 55 to the base member 54. As a result, it is possible to further extend the service life of the spark plug 1.

In addition, it should be noted that the noble metal layer 55 may also be joined to the base member 54 by other methods, such as welding.

As shown in FIGS. 1-2, the housing 2 has a male-threaded portion 22 formed on an outer periphery thereof, so that the spark plug 1 can be mounted to the engine by fastening the male-threaded portion 22 into a female-threaded bore (not shown) formed in the engine. The housing 2 is made, for example, of an iron (Fe) alloy.

Moreover, the housing 2 has an inner shoulder 23 formed on an inner periphery thereof. On the other hand, the insulator 3 has an outer shoulder 31 formed on an outer periphery thereof. The insulator 3 is retained in the housing 2 with the outer shoulder 31 of the insulator 3 engaging with the inner shoulder 23 of the housing 2 in the axial direction of the spark plug 1. In addition, between the outer shoulder 31 of the insulator 3 and the inner shoulder 23 of the housing 2, there is interposed an annular packing 11.

Next, a method of manufacturing the spark plug 1 according to the present embodiment will be described. The method includes an assembly step and a joining step.

Figure 6:
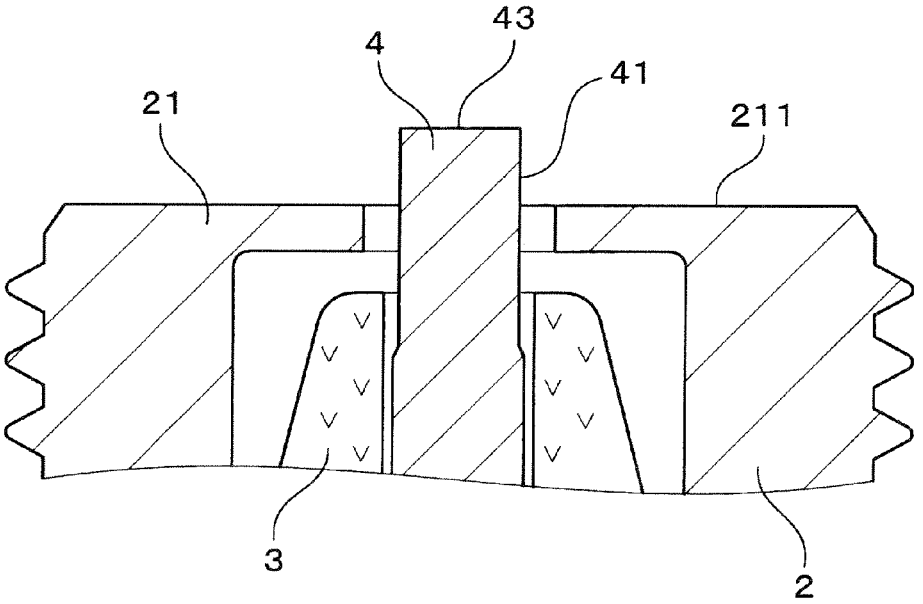
FIG. 6 is a cross-sectional view of the distal part of the spark plug according to the first embodiment before joining the ground electrode to a housing of the spark plug.

In the assembly step, the insulator 3 and the center electrode 4 are first assembled so that the center electrode 4 is secured in the insulator 3 with the distal end portion of the center electrode 4 protruding outside the insulator 3. Then, as shown in FIG. 6, the assembly of the insulator 3 and the center electrode 4 is further assembled into the housing 2 so that the distal end portion of the center electrode 4 extends through the internal space of the small-inner diameter portion 21 of the housing 2.

In the joining step, the ground electrode 5 is joined to the distal end surface 211 of the small-inner diameter portion 21 of the housing 2, as shown in FIG. 4. Moreover, in this step, the spark gap G between the center electrode 4 and the ground electrode 5 is adjusted.

Specifically, in the joining step, the annular ground electrode 5 shown in FIGS. 5A-5B is first placed on the distal end surface 211 of the small-inner diameter portion 21 of the housing 2 so that the distal end portion of the center electrode 4 is located inside the ground electrode 5. Then, the relative position of the ground electrode 5 to the distal end portion of the center electrode 4 is adjusted by radially sliding the ground electrode 5 on the distal end surface 211 of the small-inner diameter portion 21 of the housing 2. More specifically, the relative position of the ground electrode 5 to the distal end portion of the center electrode 4 is adjusted so as to make the spark gap G between the inner circumferential surface 51 of the ground electrode 5 and the outer circumferential surface 41 of the distal end portion of the center electrode 4 have a desired constant radial width over the entire circumference of the spark gap G. Here, the distal end surface 211 of the small-inner diameter portion 21 of the housing 2 is a flat surface perpendicular to the axial direction of the spark plug 1; it is therefore possible to accurately adjust the relative position of the ground electrode 5 to the distal end portion of the center electrode 4. Upon completion of the adjustment, the ground electrode 5 is welded, for example by resistance welding or laser welding, to the distal end surface 211 of the small-inner diameter portion 21 of the housing 2. In addition, the welding process may be performed between an outer circumferential edge of the proximal end surface 52 of the ground electrode 5 and the distal end surface 211 of the small-inner diameter portion 21 of the housing 2 over the entire circumference of the outer circumferential edge.

As a result, the spark plug 1 according to the present embodiment is obtained.

To sum up, according to the present embodiment, it is possible to achieve the following advantageous effects.

In the present embodiment, the spark plug 1 includes: the tubular housing 2; the tubular insulator 3 retained in the housing 2; the center electrode 4 secured in the insulator 3 with the distal end portion of the center electrode 4 protruding outside the insulator 3; and the annular ground electrode 5 fixed to the distal end of the housing 2. The housing 2 has, at the distal end thereof, the small-inner diameter portion 21 that has a smaller inner diameter than other portions of the housing 2. The ground electrode 5 is arranged on the distal end surface 211 of the small-inner diameter portion 21 of the housing 2 so that: the ground electrode 5 protrudes distalward from the distal end surface 211 of the small-inner diameter portion 21 of the housing 2; and the inner circumferential surface 51 of the ground electrode 5 faces the outer circumferential surface 41 of the distal end portion of the center electrode 4 through the spark gap G formed therebetween. The outer diameter D1 of the ground electrode 5 is less than the outer diameter D0 of the distal end surface 211 of the small-inner diameter portion 21 of the housing 2.

With the above configuration, the ground electrode 5 and the housing 2 face and abut each other in the axial direction of the spark plug 1. Consequently, it becomes possible to secure a large contact area between the ground electrode 5 and the housing 2 and shorten the heat dissipation path from the inner circumferential surface 51 of the ground electrode 5, which faces the spark gap G, to the housing 2. As a result, it becomes possible to effectively dissipate heat from the ground electrode 5 to the housing 2, thereby suppressing increase in the temperature of the ground electrode 5. Further, with the suppression of increase in the temperature of the ground electrode 5, it becomes possible to suppress the wear of the ground electrode 5 at the inner circumferential surface 51 thereof, thereby suppressing increase in the radial width of the spark gap G and thus extending the service life of the spark plug 1.

Moreover, with the above configuration, the spark gap G is located distalward from the distal end of the housing 2. Consequently, it becomes possible to prevent, during the growth of the flame produced by a spark discharge in the spark gap G, the flame from making contact with the housing 2 and thus from loosing heat to the housing 2. As a result, it becomes possible to facilitate the growth of the flame, thereby improving the ignition capability of the spark plug 1.

Furthermore, with the above configuration, in joining the ground electrode 5 to the housing 2, it is possible to easily adjust the relative position of the ground electrode 5 to the center electrode 4 by sliding the ground electrode 5 on the distal end surface 211 of the small-inner diameter portion 21 of the housing 2. As a result, it is possible to easily adjust the spark gap G even when there are dimensional and assembly variations in the components of the spark plug.

In the present embodiment, the method of manufacturing the spark plug 1 includes: the assembly step in which the insulator 3 and the center electrode 4 are assembled into the housing 2 so that the distal end portion of the center electrode 4 extends through the internal space of the small-inner diameter portion 21 of the housing 2; and the joining step in which the ground electrode 5 is joined to the distal end surface 211 of the small-inner diameter portion 21 of the housing 2. Moreover, in the joining step, the spark gap G between the inner circumferential surface 51 of the ground electrode 5 and the outer circumferential surface 41 of the distal end portion of the center electrode 4 is adjusted and then the ground electrode 5 is joined to the distal end surface 211 of the small-inner diameter portion 21 of the housing 2.

With the above method, the adjustment of the spark gap G can be completed by the time point at which the ground electrode 5 is joined to the distal end surface 211 of the small-inner diameter portion 21 of the housing 2. Consequently, it is possible to easily obtain the spark plug 1 where the spark gap G is accurately formed between the inner circumferential surface 51 of the ground electrode 5 and the outer circumferential surface 41 of the distal end portion of the center electrode 4.

[Experiment 1]

This experiment was conducted by the inventors of the present invention to determine the effect of the axial height H of the ground electrode 5 on the concentration of electric field on the outer circumferential surface 41 of the distal end portion of the center electrode 4.

Specifically, a plurality of spark plug samples were prepared, in each of which: the diameter of the distal end portion of the center electrode 4 was set to 2.4 mm; the inner diameter D3 of the ground electrode 5 was set to 3.1 mm; and the axial distance h between the distal end surface 43 of the center electrode 4 and the distal end surface 53 of the ground electrode 5 was set to 0.3 mm. However, the axial height H of the ground electrode 5 was varied for those spark plug samples.

In the experiment, for each of the spark plug samples, an electric field analysis was performed in the spark gap G of the sample with a voltage of 12 kV applied to the center electrode 4 of the sample.

The analysis results revealed that: in the range of the axial height H less than 0.8 mm, the electric field strength on the outer circumferential surface 41 of the distal end portion of the center electrode 4 decreased with the axial height H; and in the range of the axial height H greater than or equal to 0.8 mm, the electric field strength on the outer circumferential surface 41 was saturated at a high value in the vicinity of an axially central portion of the spark gap G.

Accordingly, it has been made clear from the analysis results that setting the axial height H to be greater than or equal to 0.8 mm (i.e., $H \geq 0.8$ mm), a sufficient electric field concentration effect can be achieved, thereby lowering the required voltage of the spark plug 1 for discharging a spark across the spark gap G.

[Experiment 2]

This experiment was conducted by the inventors of the present invention to determine the effect of the axial height H of the ground electrode 5 on the ignition capability of the spark plug 1.

Specifically, a plurality of spark plug samples were prepared, in each of which: the diameter of the distal end portion of the center electrode 4 was set to 2.4 mm; the inner diameter D3 of the ground electrode 5 was set to 3.1 mm; and the axial distance h between the distal end surface 43 of the center electrode 4 and the distal end surface 53 of the ground electrode 5 was set to 0.3 mm. However, the axial height H of the ground electrode 5 was varied for those spark plug samples. More specifically, in each of the spark plug samples, the axial height H of the ground electrode 5 was set to one of 1.0 mm, 1.5 mm, 2.0 mm, 2.5 mm, 3.0 mm, 3.5 mm, 4.0 mm, 4.2 mm and 4.5 mm.

In the experiment, each of the spark plug samples was first installed to a 16-cylinder 100 L internal combustion engine of a cogeneration system. Then, the engine was operated at the stoichiometric air/fuel ratio and a low rotational speed (e.g., 2000 rpm). During the operation of the engine, the COV (Coefficient OF Variance) of the engine was measured.

The measurement results revealed that when the axial height H of the ground electrode 5 was less than or equal to 3 mm, it was possible to sufficiently suppress the COV of the engine (more specifically, suppress the COV of the engine to be lower than or equal to 3%).

Accordingly, it has been made clear from the measurement results that setting the axial height H to be less than or equal to 3 mm (i.e., $H \leq 3$ mm), it is possible to secure a sufficiently stable ignition capability of the spark plug 1.

Summarizing the results of Experiments 1 and 2, it has been clear that setting the axial height H to be in the range of 0.8 to 3 mm, it is possible to lower the required voltage of the spark plug 1, extend the service life of the spark plug 1 and improve the ignition capability of the spark plug 1.

Second Embodiment

Figure 7:
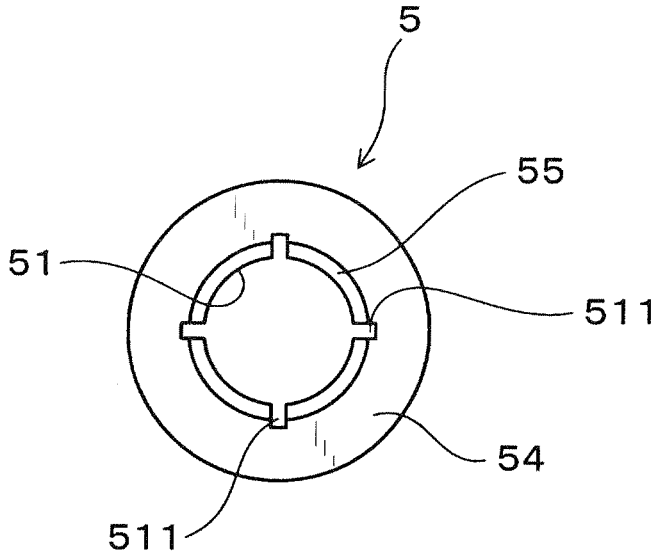
FIG. 7 is a plan view of a ground electrode according to a second embodiment.
Figure 8:
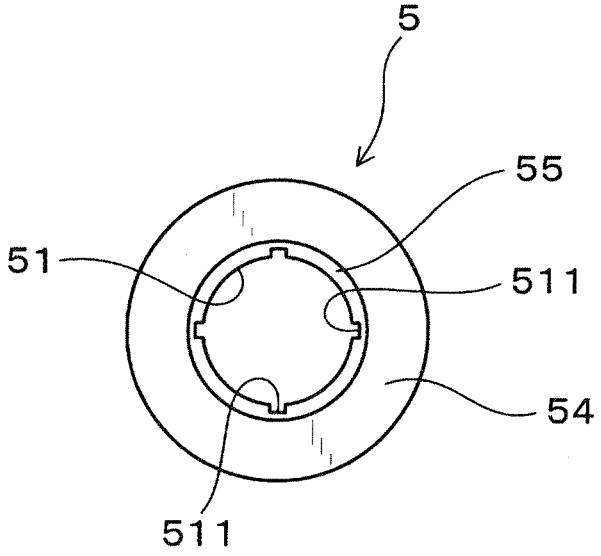
FIG. 8 is a plan view of another ground electrode according to the second embodiment.

In this embodiment, the ground electrode 5 has at least one groove (or cut) 511 that is formed in the inner circumferential surface 51 of the ground electrode 5 along the axial direction of the spark plug 1, as shown in FIGS. 7-8.

More specifically, in the present embodiment, the ground electrode 5 has four grooves 511 that are cut in the inner circumferential surface 51 of the ground electrode 5 so as to extend in the axial direction of the spark plug 1. The four grooves 511 are circumferentially spaced from one another at equal intervals.

Moreover, as shown in FIG. 7, the grooves 511 may be formed so as to be deeper than the thickness of the noble metal layer 55 of the ground electrode 5. In other words, the grooves 511 may be cut into part of the base member 54 of the ground electrode 5 through the noble metal layer 55.

Alternatively, as shown in FIG. 8, the grooves 511 may be formed so as to be shallower than the thickness of the noble metal layer 55 of the ground electrode 5. In other words, the grooves 511 may be cut into only part of the noble metal layer 55 so as not to cause the noble metal layer 55 to be divided by the grooves 511.

With the grooves 511 formed in the inner circumferential surface 51 of the ground electrode 5, it is possible to reliably prevent the spark gap G from being changed in dimension under severe conditions of repetitive heating and cooling cycles.

Specifically, the ground electrode 5 is two-part formed so that the noble metal layer 55 having a relatively low coefficient of linear expansion is located radially inside the annular base member 54 having a relatively high coefficient of linear expansion. Therefore, without the grooves 511, plastic deformation might occur in the noble metal layer 55 under severe conditions of repetitive heating and cooling cycles. More specifically, without the grooves 511, when the base member 54 contracts according to the heating and cooling cycles, the noble metal layer 55 could not accordingly contract in the circumferential direction, thus being partially plastically deformed radially inward. Consequently, the spark gap G might be partially changed in dimension due to the plastic deformation of the noble metal layer 55.

However, in the present embodiment, with the grooves 511 formed in the inner circumferential surface 51 of the ground electrode 5, when the noble metal layer 55 contracts along with the base member 54, it is possible to absorb the decrease in diameter of the noble metal layer 55, thereby preventing the noble metal layer 55 from being radially deformed. Consequently, it is possible to reliably prevent the spark gap G from being changed in dimension.

Third Embodiment

FIGS. 9-12 show the overall configuration of a spark plug 1 according to a third embodiment.

As shown in FIGS. 9-12, the spark plug 1 according to the present embodiment includes: a tubular housing 2; a tubular insulator 3 retained in the housing 2; a center electrode 4 secured in the insulator 3 such that a distal end portion of the center electrode 4 protrudes outside the insulator 3; and an annular ground electrode 5 fixed to a distal end surface of the housing 2 so as to surround the distal end portion of the center electrode 4.

The housing 2 has a small-inner diameter portion 21 at a distal end thereof. The small-inner diameter portion 21 has a smaller inner diameter D4 than other portions of the housing 2. In addition, the small-inner diameter portion 21 has a distal end surface 211 which defines the distal end surface of the housing 2. In other words, the distal end surface 211 is located most distalward (i.e., toward the distal side) in the housing 2.

In the present embodiment, the center electrode 4 has a substantially cylindrical shape and is coaxially arranged with the tubular (or substantially hollow cylindrical) housing 2, the tubular (or substantially hollow cylindrical) insulator 3 and the annular (or substantially hollow cylindrical) ground electrode 5.

Figure 9:
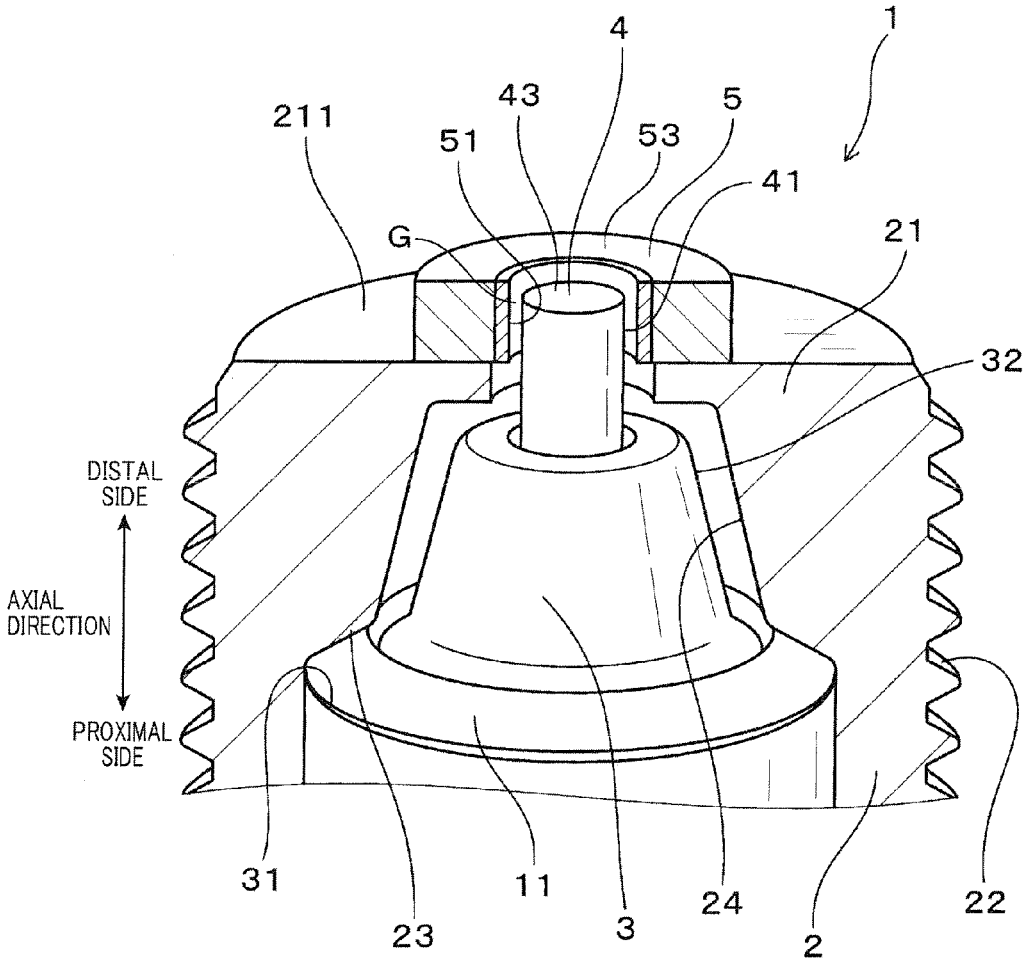
FIG. 9 is a schematic perspective view of a distal part of a spark plug according to a third embodiment.

As shown in FIG. 9, the distal end surface 211 of the housing 2 is flat in shape and arranged perpendicular to the axial direction of the spark plug 1. The ground electrode 5 has a proximal end surface 52 and a distal end surface 53, both of which are flat in shape. The ground electrode 5 is joined to the housing 2 with the proximal end surface 52 of the ground electrode 5 and the distal end surface 211 of the housing 2 in surface contact with each other.

The ground electrode 5 is arranged on the distal end surface 211 of the small-inner diameter portion 21 of the housing 2 so that: the ground electrode 5 protrudes distalward from the distal end surface 211; and an inner circumferential surface 51 of the ground electrode 5 faces an outer circumferential surface 41 of the distal end portion of the center electrode 4 through an annular spark gap G formed therebetween.

Figure 12:
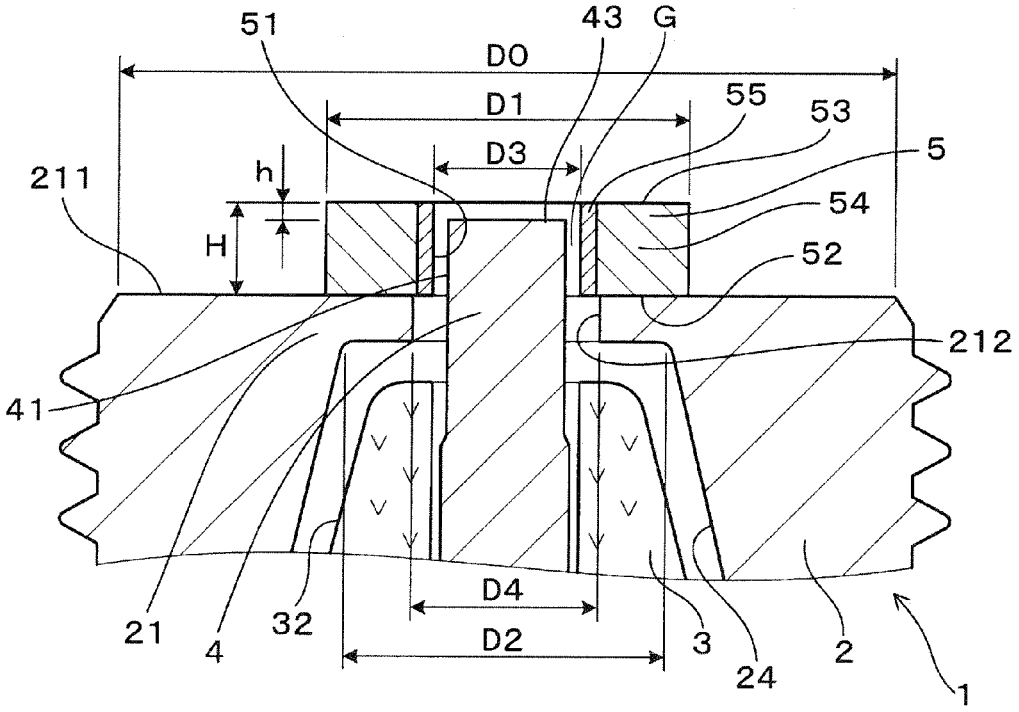
FIG. 12 is a schematic cross-sectional view of the distal part of the spark plug according to the third embodiment.

Moreover, as shown in FIG. 12, the ground electrode 5 has an outer diameter D1 that is less than an outer diameter D0 of the distal end surface 211 of the small-inner diameter portion 21 of the housing 2. Preferably, the outer diameter D1 is in the range of 5 to 10 mm while the outer diameter D0 is in the range of 12 to 22 mm. More preferably, the outer diameter D1 is in the range of 5 to 7 mm while the outer diameter D0 is in the range of 14 to 22 mm.

Since the ground electrode 5, whose outer diameter D1 is less than the outer diameter D0 of the distal end surface 211 of the small-inner diameter portion 21 of the housing 2, is joined to the distal end surface 211, the ground electrode 5 and the housing 2 face and abut each other in the axial direction of the spark plug 1. Consequently, it becomes possible to shorten the heat dissipation path from the inner circumferential surface 51 of the ground electrode 5, which faces the spark gap G, to the housing 2, thereby suppressing increase in the temperature of the ground electrode 5.

Figure 10:
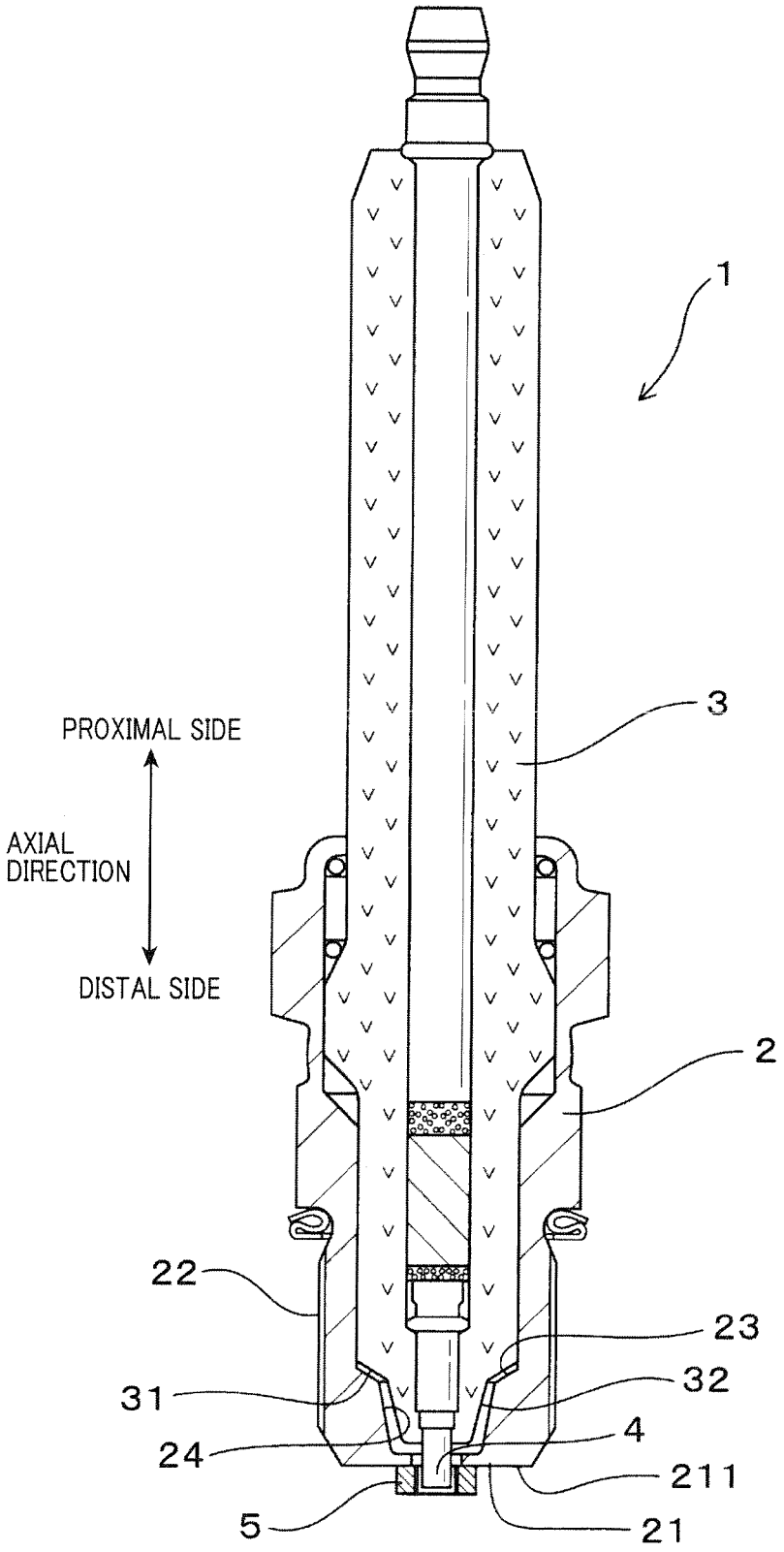
FIG. 10 is a cross-sectional view of the spark plug according to the third embodiment.

In the present embodiment, as shown in FIGS. 9-10 and 12, the housing 2 has an inner shoulder 23 formed on an inner periphery thereof. On the other hand, the insulator 3 has an outer shoulder 31 formed on an outer periphery thereof. The insulator 3 is retained in the housing 2 with the outer shoulder 31 of the insulator 3 engaging with the inner shoulder 23 of the housing 2 in the axial direction of the spark plug 1. In addition, between the outer shoulder 31 of the insulator 3 and the inner shoulder 23 of the housing 2, there is interposed an annular packing 11.

Moreover, in the present embodiment, the housing 2 also has a reduced-inner diameter portion 24 which extends from the inner shoulder 23 to the small-inner diameter portion 21 of the housing 2 and whose inner diameter is reduced in the distalward direction. On the other hand, the insulator 3 also has a reduced-outer diameter portion 32 which extends from the outer shoulder 31 to a distal end of the insulator 3 and whose outer diameter is reduced in the distalward direction.

More particularly, in the present embodiment, both the reduced-inner diameter portion 24 of the housing 2 and the reduced-outer diameter portion 32 of the insulator 3 are linearly tapered distalward.

Moreover, both the taper angle of the reduced-inner diameter portion 24 of the housing 2 and the taper angle of the reduced-outer diameter portion 32 of the insulator 3 are in the range of, for example, 5 to 25°. Here, the taper angles of the reduced-inner diameter portion 24 and the reduced-outer diameter portion 32 denote those angles which the reduced-inner diameter portion 24 and the reduced-outer diameter portion 32 make, on a cross section of the spark plug 1 which includes the central axis of the spark plug 1 (see FIG. 12), with respect to the axial direction of the spark plug 1.

Furthermore, the minimum distance between the reduced-inner diameter portion 24 of the housing 2 and the reduced-outer diameter portion 32 of the insulator 3 is set to be not less than the upper limit for the radial width of the spark gap G. As described previously, when the radial width of the spark gap G is increased with use of the spark plug 1 to exceed the upper limit, the spark plug 1 becomes unable to normally function. More particularly, in the present embodiment, the minimum distance is set to be equal to, for example, 0.7 mm.

Setting the minimum distance as above, during the service life of the spark plug, it is possible to reliably cause a spark discharge to take place in the spark gap G.

In the present embodiment, the outer diameter D1 of the ground electrode 5 is greater than the inner diameter D2 of the reduced-inner diameter portion 24 of the housing 2 at a distal end of the reduced-inner diameter portion 24. Moreover, the difference between the outer diameter D1 of the ground electrode 5 and the inner diameter D2 of the reduced-inner diameter portion 24 of the housing 2 is less than or equal to 7 mm.

In the present embodiment, the spark gap G, which is formed between the inner circumferential surface 51 of the ground electrode 5 and the outer circumferential surface 41 of the distal end portion of the center electrode 4, is located distalward from the distal end surface 211 of the small-inner diameter portion 21 of the housing 2. Therefore, the housing 2 is not present in the direction of growth of the flame produced by a spark discharge in the spark gap G. Consequently, it becomes possible to prevent growth of the flame from being hindered by the housing 2. That is, it becomes possible to prevent the flame from making contact with the housing 2 and thus from loosing heat to the housing 2. As a result, it becomes possible to secure a high ignition capability of the spark plug 1.

In the present embodiment, as shown in FIG. 12, the ground electrode 5 has its distal end surface 53 located distalward from a distal end surface 43 of the center electrode 4. It is preferable that the distal end surface 53 of the ground electrode 5 is located distalward from the distal end surface 43 of the center electrode 4 by 0.1 to 0.3 mm and distalward from the distal end surface 211 of the small-inner diameter portion 21 of the housing 2 by 0.8 to 3 mm. In other words, it is preferable that the axial distance h between the distal end surface 43 of the center electrode 4 and the distal end surface 53 of the ground electrode 5 is in the range of 0.1 to 0.3 mm and the axial height H of the ground electrode 5 is in the range of 0.8 to 3 mm.

With the above configuration, it is possible to effectively enhance the electric field strength in the vicinity of the outer circumferential surface 41 of the distal end portion of the center electrode 4.

More specifically, upon application of a voltage between the ground electrode 5 and the center electrode 4, electric field is created in the spark gap G formed between the inner circumferential surface 51 of the ground electrode 5 and the outer circumferential surface 41 of the distal end portion of the center electrode 4. With the ground electrode 5 protruding more distalward than the center electrode 4, it becomes easy for the electric field to concentrate on the outer circumferential surface 41 of the distal end portion of the center electrode 4. Consequently, it becomes easy for electrons to be emitted from the center electrode 4, thereby lowering the required voltage of the spark plug 1 for discharging a spark across the spark gap G.

With the axial height H of the ground electrode 5 set to be greater than or equal to 0.8 mm, it is possible to improve the effect of the electric field concentration on the outer circumferential surface 41 of the distal end portion of the center electrode 4. Moreover, it is also possible to secure the wear resistance of the inner circumferential surface 51 of the ground electrode 5, thereby extending the service life of the spark plug 1. On the other hand, with the axial height H of the ground electrode 5 set to be less than or equal to 3 mm, when a spark discharge takes place in the vicinity of the proximal end of the spark gap G, it is still possible to prevent a misfire from occurring due to the loss of heat of the flame produced by the spark discharge, thereby securing the ignition capability of the spark plug 1. Moreover, it is also possible to allow the air-fuel mixture to smoothly flow into and out of the internal space 13 of the housing 2 via the spark gap G. Consequently, it is possible to sufficiently introduce the air-fuel mixture to the spark gap G, thereby more reliably securing the ignition capability of the spark plug 1.

In the present embodiment, the ground electrode 5 has an inner diameter D3 that is less than the inner diameter D4 of the small-inner diameter portion 21 of the housing 2. More specifically, the inner diameter D3 is in the range of 2.8 to 3.4 mm while the inner diameter D4 is in the range of 3.6 to 4.0 mm. Consequently, it is possible to easily adjust the spark gap G by radially moving the ground electrode 5. In particular, it is possible to prevent an inner circumferential surface 212 of the small-inner diameter portion 21 of the housing 2 from being located radially inside the inner circumferential surface 51 of the ground electrode 5 even when there are dimensional and assembly variations in the components of the spark plug 1. Moreover, the inner circumferential surface 51 of the ground electrode 5 protrudes, over the entire circumference thereof, radially inward from the inner circumferential surface 212 of the small-inner diameter portion 21 of the housing 2, thereby making the radial width of the spark gap G constant over the entire circumference.

Figure 11:
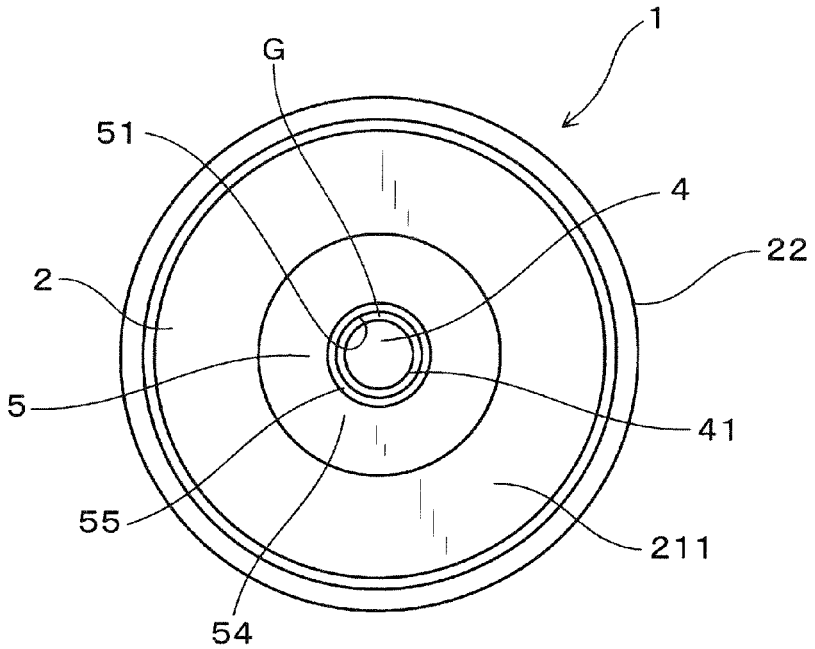
FIG. 11 is a plan view, from the distal side, of the spark plug according to the third embodiment.

More specifically, as shown in FIGS. 9 and 12, the inner circumferential surface 51 of the ground electrode 5 extends parallel to the outer circumferential surface 41 of the distal end portion of the center electrode 4. Moreover, as shown in FIG. 11, the radial width of the spark gap G formed between the inner circumferential surface 51 of the ground electrode 5 and the outer circumferential surface 41 of the distal end portion of the center electrode 4 is constant in the circumferential direction of the spark plug 1. In other words, the spark gap G is formed over the entire circumference of the inner circumferential surface 51 of the ground electrode 5 so as to have a constant radial width over the entire circumference. Consequently, it is possible to realize a stable spark discharge in the spark gap G.

Figure 13A:
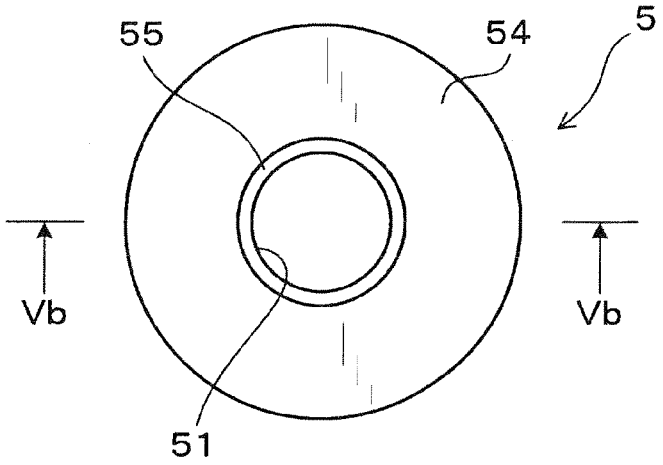
FIG. 13A is a plan view of a ground electrode of the spark plug according to the third embodiment.
Figure 13B:
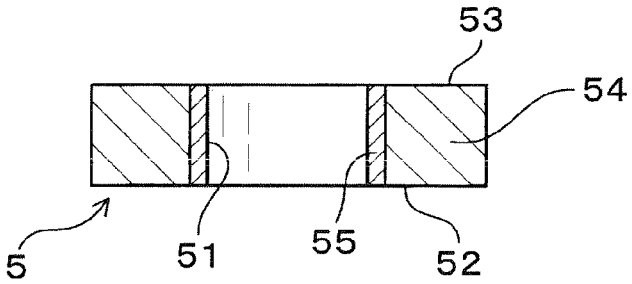
FIG. 13B is a cross-sectional view of the ground electrode taken as indicated by the arrows Vc in FIG. 13A.

In the present embodiment, as shown in FIGS. 12 and 13A-13B, the ground electrode 5 includes an annular base member 54 and a noble metal layer 55 provided on an inner circumferential surface of the base member 54. The base member 54 is made, for example, of a nickel (Ni) alloy. The noble metal layer 55 is made, for example, of platinum (Pt), iridium (Ir) or an alloy thereof. Moreover, the noble metal layer 55 is diffusion-bonded to the base member 54. The thickness of the noble metal layer 55 is set to be in the range of, for example, 0.1 to 0.5 mm.

With the above two-part formation of the ground electrode 5, it is possible to improve the wear resistance of the ground electrode 5, thereby effectively extending the service life of the spark plug 1.

Moreover, by diffusion-bonding the noble metal layer 55 to the base member 54, it is possible to secure the adhesion strength of the noble metal layer 55 to the base member 54 while enhancing heat dissipation from the noble metal layer 55 to the base member 54. As a result, it is possible to further extend the service life of the spark plug 1.

In addition, it should be noted that the noble metal layer 55 may also be joined to the base member 54 by other methods, such as welding.

As shown in FIGS. 9-10, the housing 2 has a male-threaded portion 22 formed on an outer periphery thereof, so that the spark plug 1 can be mounted to the engine by fastening the male-threaded portion 22 into a female-threaded bore (not shown) formed in the engine. The housing 2 is made, for example, of an iron (Fe) alloy.

Next, a method of manufacturing the spark plug 1 according to the present embodiment will be described. The method includes an assembly step and a joining step.

Figure 14:
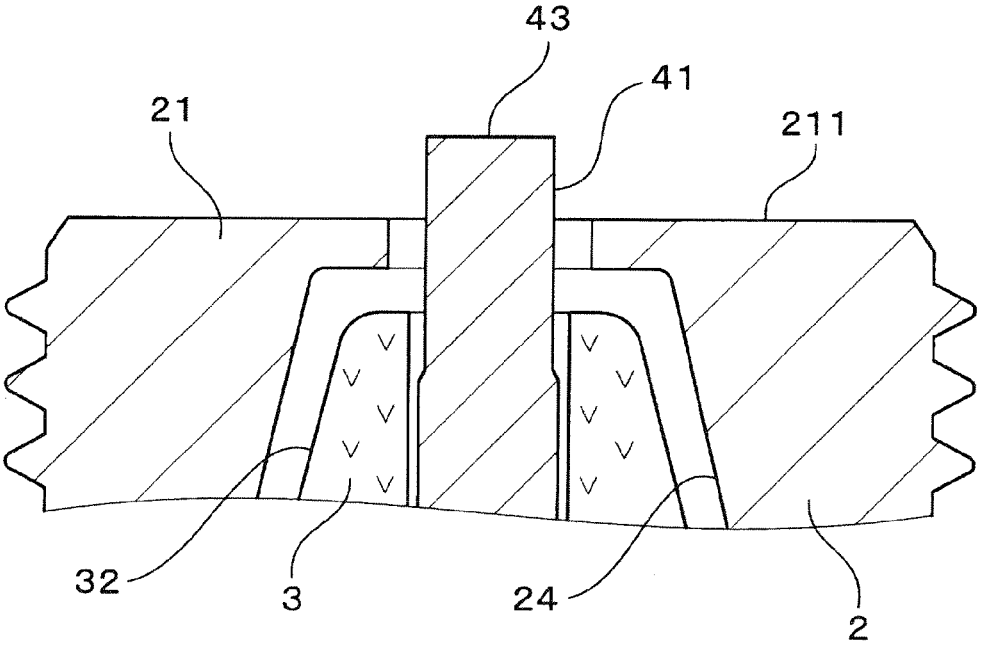
FIG. 14 is a cross-sectional view of the distal part of the spark plug according to the third embodiment before joining the ground electrode to a housing of the spark plug.

In the assembly step, the insulator 3 and the center electrode 4 are first assembled so that the center electrode 4 is secured in the insulator 3 with the distal end portion of the center electrode 4 protruding outside the insulator 3. Then, as shown in FIG. 14, the assembly of the insulator 3 and the center electrode 4 is further assembled into the housing 2 so that the distal end portion of the center electrode 4 extends through the internal space of the small-inner diameter portion 21 of the housing 2.

In the joining step, the ground electrode 5 is joined to the distal end surface 211 of the small-inner diameter portion 21 of the housing 2, as shown in FIG. 12. Moreover, in this step, the spark gap G between the center electrode 4 and the ground electrode 5 is adjusted.

Specifically, in the joining step, the annular ground electrode 5 shown in FIGS. 13A-13B is first placed on the distal end surface 211 of the small-inner diameter portion 21 of the housing 2 so that the distal end portion of the center electrode 4 is located inside the ground electrode 5. Then, the relative position of the ground electrode 5 to the distal end portion of the center electrode 4 is adjusted by radially sliding the ground electrode 5 on the distal end surface 211 of the small-inner diameter portion 21 of the housing 2. More specifically, the relative position of the ground electrode 5 to the distal end portion of the center electrode 4 is adjusted so as to make the spark gap G between the inner circumferential surface 51 of the ground electrode 5 and the outer circumferential surface 41 of the distal end portion of the center electrode 4 have a desired constant radial width over the entire circumference of the spark gap G. Here, the distal end surface 211 of the small-inner diameter portion 21 of the housing 2 is a flat surface perpendicular to the axial direction of the spark plug 1; it is therefore possible to accurately adjust the relative position of the ground electrode 5 to the distal end portion of the center electrode 4. Upon completion of the adjustment, the ground electrode 5 is welded, for example by resistance welding or laser welding, to the distal end surface 211 of the small-inner diameter portion 21 of the housing 2. In addition, the welding process may be performed between an outer circumferential edge of the proximal end surface 52 of the ground electrode 5 and the distal end surface 211 of the small-inner diameter portion 21 of the housing 2 over the entire circumference of the outer circumferential edge.

As a result, the spark plug 1 according to the present embodiment is obtained.

With the above method, the adjustment of the spark gap G can be completed by the time point at which the ground electrode 5 is joined to the distal end surface 211 of the small-inner diameter portion 21 of the housing 2. Consequently, it is possible to easily obtain the spark plug 1 where the spark gap G is accurately formed between the inner circumferential surface 51 of the ground electrode 5 and the outer circumferential surface 41 of the distal end portion of the center electrode 4.

According to the present embodiment, it is possible to achieve the same advantageous effects as described in the first embodiment.

Moreover, in the present embodiment, the housing 2 has the inner shoulder 23 formed on the inner periphery thereof, and the insulator 3 has the outer shoulder 31 formed on the outer periphery thereof. The insulator 3 is retained in the housing 2 with the outer shoulder 31 of the insulator 3 engaging with the inner shoulder 23 of the housing 2 in the axial direction of the spark plug 1. The housing 2 also has the reduced-inner diameter portion 24 which extends from the inner shoulder 23 to the small-inner diameter portion 21 of the housing 2 and whose inner diameter is reduced in the distalward direction. The insulator 3 also has the reduced-outer diameter portion 32 which extends from the outer shoulder 31 to the distal end of the insulator 3 and whose outer diameter is reduced in the distalward direction. More particularly, in the present embodiment, both the reduced-inner diameter portion 24 of the housing 2 and the reduced-outer diameter portion 32 of the insulator 3 are tapered distalward.

With the above configuration, it is possible to more effectively dissipate the heat of the ground electrode 5 via the housing 2. In particular, with the tapered shapes of the reduced-inner diameter portion 24 of the housing 2 and the reduced-outer diameter portion 32 of the insulator 3, it is possible to further improve the efficiency of dissipating the heat of the ground electrode 5 via the housing 2, thereby further extending the service life of the spark plug 1.

Specifically, when a high voltage is applied to the center electrode 4, a large difference in electric potential will be created between the housing 2 and the center electrode 4. Therefore, to electrically insulate the housing 2 and the center electrode 4 from each other, there is provided the insulator 3 between the housing 2 and the center electrode 4. Further, to prevent an electrical breakdown of the insulator 3 from occurring, it is necessary to secure a sufficient radial thickness of the insulator 3. In particular, it is essential to secure a sufficient radial thickness of the insulator 3 at the outer shoulder 31 of the insulator 3 which engages with the inner shoulder 23 of the housing 2 via the packing 11 interposed therebetween. In contrast, on the distal side of the outer shoulder 31, the insulator 3 does not engage with the housing 2; it is therefore possible to secure the insulating function of the insulator 3 with a relatively small radial thickness of the insulator 3. In view of the above, in the present embodiment, the insulator 3 is configured to have the reduced-outer diameter portion 32 on the distal side of the outer shoulder 31.

On the other hand, the larger the radial thicknesses of the solid (i.e., not hollow) portions of the housing 2, the more effectively the heat of the ground electrode 5 can be dissipated. In other words, by increasing the radial thicknesses of the solid portions of the housing 2, it is possible to more effectively dissipate the heat of the ground electrode 5 via the housing 2. However, in setting the radial thicknesses of the solid portions of the housing 2, there are constrains relating to the insulator 3 located inside the housing 2 and the outer diameter of the male-threaded portion 22 of the housing 2.

Among the solid portions of the housing 2, the solid portion which radially faces the reduced-outer diameter portion 32 of the insulator 3 can be formed most radially inward without causing interference with the insulator 3. That is, it is possible to reduce the inner diameter of the solid portion which radially faces the reduced-outer diameter portion 32 of the insulator 3, thereby increasing the radial thickness of the solid portion. In view of the above, in the present embodiment, the solid portion of the housing 2 which radially faces the reduced-outer diameter portion 32 of the insulator 3 is configured as the reduced-inner diameter portion 24. In other words, the housing 2 is configured to have the reduced-inner diameter portion 24 whose inner diameter is reduced in the distalward direction and thus whose radial thickness is increased in the distalward direction. Moreover, the reduced-inner diameter portion 24 is formed in close vicinity to the ground electrode 5. Consequently, with the reduced-inner diameter portion 24, it is possible to more effectively dissipate the heat of the ground electrode 5 via the housing 2.

In the present embodiment, the outer diameter D1 of the ground electrode 5 is set to be greater than the inner diameter D2 of the reduced-inner diameter portion 24 of the housing 2 at the distal end of the reduced-inner diameter portion 24 (see FIG. 12).

Setting the outer diameter D1 to be greater than the inner diameter D2, it becomes possible to locate the entire radially outer periphery of the ground electrode 5 radially outside the inner circumferential edge of the reduced-inner diameter portion 24 of the housing 2 at the distal end of the reduced-inner diameter portion 24. Consequently, it becomes possible to secure a large contact area between the housing 2 and the ground electrode 5, thereby effectively dissipating the heat of the ground electrode 5 via the housing 2. Moreover, it also becomes possible to arrange a radially outer peripheral portion of the ground electrode 5 on that part of the small-inner diameter portion 21 of the housing 2 which is supported by the reduced-inner diameter portion 24 from the proximal side. Consequently, it becomes possible to prevent the small-inner diameter portion 21 of the housing 2 from being deformed proximalward (i.e., toward the proximal side) during the process of welding the ground electrode 5 to the housing 2.

In addition, the larger the outer diameter D1 is relative to the inner diameter D2, the more effectively the heat of the ground electrode 5 can be dissipated. However, when the difference (D1−D2) between the outer diameter D1 and the inner diameter D2 exceeds 7 mm, the improvement in dissipation of the heat of the ground electrode 5 owing to the increase in (D1−D2) becomes small. Moreover, there is a limitation in reduction of the inner diameter D2; therefore, to increase the difference (D1−D2), it is necessary to increase the outer diameter D1. However, with increase in the outer diameter D1, the material cost of the ground electrode 5 and the cost of welding the ground electrode 5 to the housing 2 are increased. In view of the above, in the present embodiment, the difference (D1−D2) is set to be less than or equal to 7 mm.

Fourth Embodiment

Figure 15:
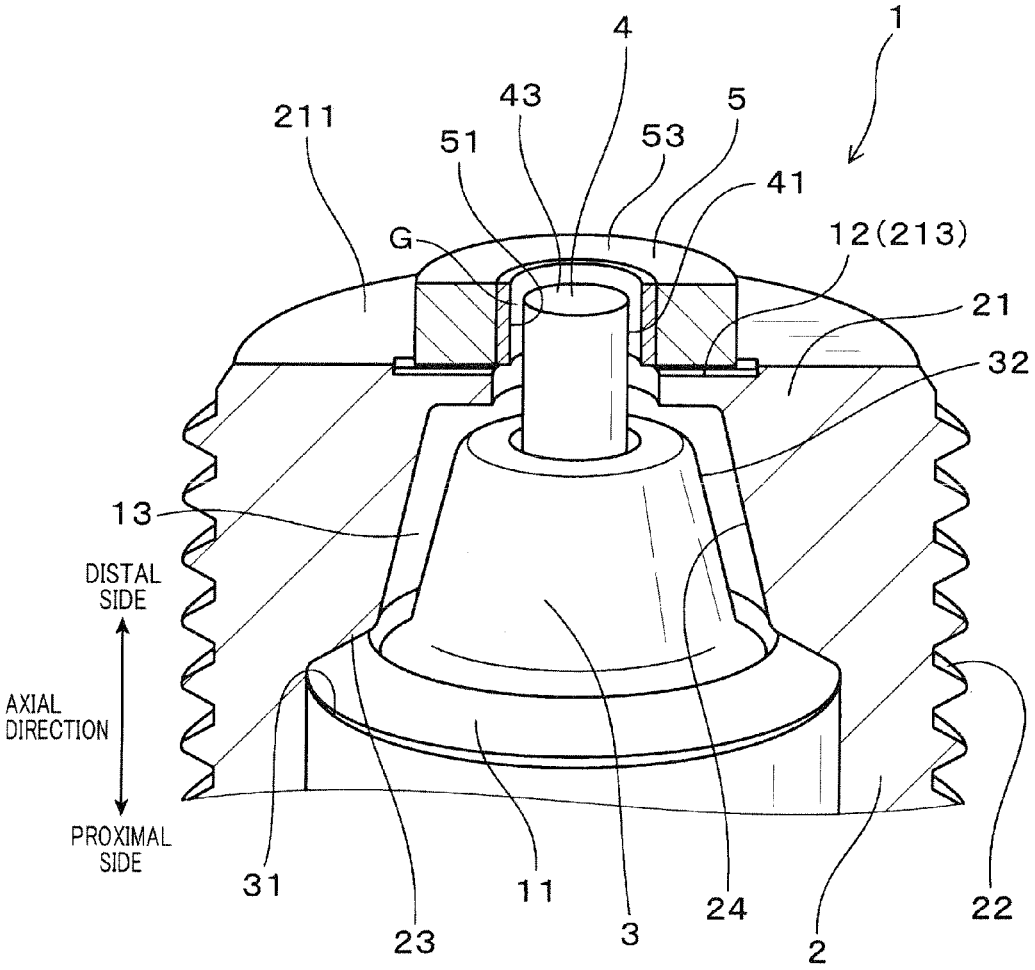
FIG. 15 is a schematic perspective view of a distal part of a spark plug according to a fourth embodiment.
Figure 16:
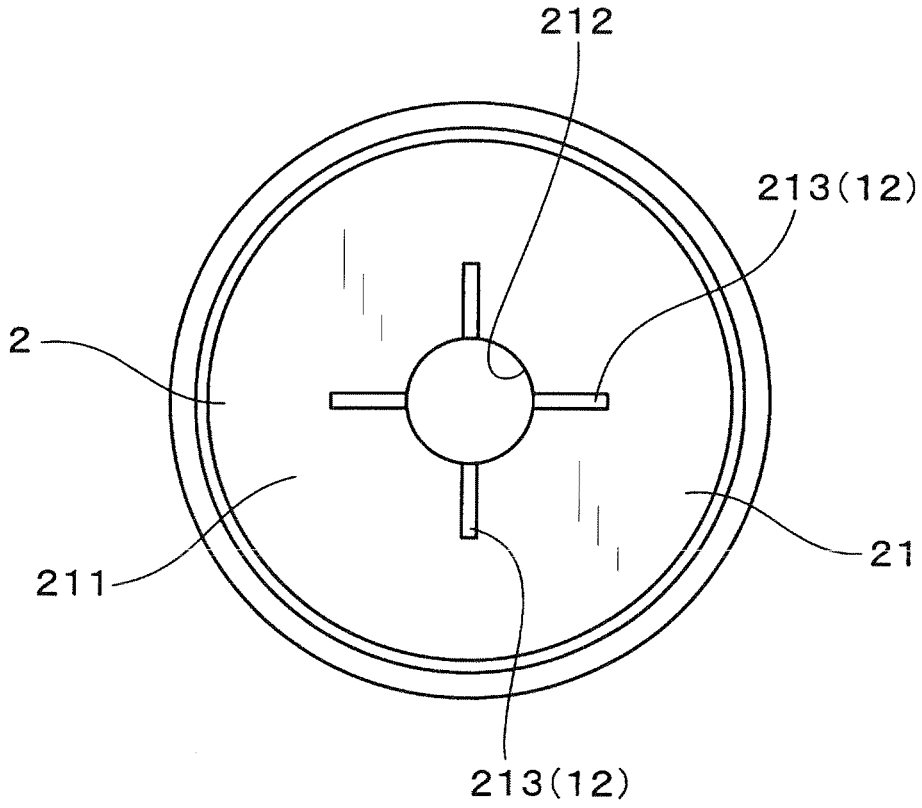
FIG. 16 is a plan view, from the distal side, of the spark plug according to the fourth embodiment omitting a ground electrode of the spark plug.

In this embodiment, as shown in FIGS. 15-16, at least one ventilation path 12 is provided between the ground electrode 5 and the small-inner diameter portion 21 of the housing 2 so as to fluidically connect the internal space of the ground electrode 5 to the external space of the ground electrode 5.

Specifically, in the present embodiment, four ventilation paths 12 are formed between the ground electrode 5 and the small-inner diameter portion 21 of the housing 2 in the following way.

First, four ventilation grooves 213 are formed in the distal end surface 211 of the small-inner diameter portion 21 of the housing 2 so as to: extend from the inner circumferential edge of the distal end surface 211 of the small-inner diameter portion 21 radially outward beyond the radially outer periphery (or the outer circumferential surface) of the ground electrode 5; and be circumferentially spaced from one another at equal intervals. Then, the ground electrode 5 is arranged on and joined to the distal end surface 211 of the small-inner diameter portion 21 of the housing 2 so as to partially cover each of the ventilation grooves 213 from the distal side. As a result, the four ventilation paths 12 are obtained each of which is constituted of one of the ventilation grooves 213.

With the ventilation paths 12, it is possible to reliably prevent the air-fuel mixture from stagnating (or remaining) in the internal space 13 of the housing 2.

More specifically, during operation of the spark plug 1, the air-fuel mixture flows into and out of the internal space 13 formed between the reduced-inner diameter portion 24 of the housing 2 and the reduced-outer diameter portion 32 of the insulator 3 via the narrow spark gap G formed between the center and ground electrodes 4 and 5. Therefore, when the spark gap G is long in the axial direction of the spark plug 1, it may be difficult for the air-fuel mixture to smoothly flow into and out of the internal space 13 via only the spark gap G. In view of the above, in the present embodiment, there are provided the ventilation paths 12 between the ground electrode 5 and the small-inner diameter portion 21 of the housing 2. Consequently, it becomes possible for the air-fuel mixture to smoothly flow into and out of the internal space 13 via not only the spark gap G but also the ventilation paths 12. As a result, it becomes possible to allow the air-fuel mixture to smoothly flow through the spark gap G, thereby reliably securing the ignition capability of the spark plug 1.

While the above particular embodiments have been shown and described, it will be understood by those skilled in the art that various modifications, changes, and improvements may be made without departing from the spirit of the present invention.

For example, in the fourth embodiment, the ventilation paths 12 are obtained by forming the ventilation grooves 213 in the distal end surface 211 of the small-inner diameter portion 21 of the housing 2. However, the ventilation paths 12 may also be obtained by forming ventilation grooves in the proximal end surface 52 of the ground electrode 5.

In the third and fourth embodiments, both the reduced-inner diameter portion 24 of the housing 2 and the reduced-outer diameter portion 32 of the insulator 3 are linearly tapered distalward. However, both the reduced-inner diameter portion 24 of the housing 2 and the reduced-outer diameter portion 32 of the insulator 3 may also be non-linearly (e.g., exponentially) tapered distalward. Otherwise, both the reduced-inner diameter portion 24 of the housing 2 and the reduced-outer diameter portion 32 of the insulator 3 may also be stepped so as to be reduced in inner or outer diameter in the distalward direction.

What is claimed is:

1. A spark plug for an internal combustion engine, the spark plug comprising:

a tubular housing;

a tubular insulator retained in the housing;

a center electrode secured in the insulator with a distal end portion of the center electrode protruding outside the insulator; and a ground electrode having an annular overall shape and fixed to a distal end of the housing, wherein the housing has, at the distal end thereof, a small-inner diameter portion that has a smaller inner diameter than other portions of the housing, the ground electrode is arranged on a distal end surface of the small-inner diameter portion of the housing so that: the ground electrode protrudes distalward from the distal end surface of the small-inner diameter portion of the housing; and an annular inner circumferential surface of the ground electrode radially faces an annular outer circumferential surface of the distal end portion of the center electrode through a spark gap formed therebetween, and an outer diameter of the ground electrode is less than an outer diameter of the distal end surface of the small-inner diameter portion of the housing.

2. The spark plug as set forth in claim 1, wherein a distal end surface of the ground electrode is located distalward from a distal end surface of the center electrode.

3. The spark plug as set forth in claim 2, wherein the distal end surface of the ground electrode is located distalward from the distal end surface of the center electrode by 0.1 to 0.3 mm and distalward from the distal end surface of the small-inner diameter portion of the housing by 0.8 to 3 mm.

4. The spark plug as set forth in claim 1, wherein an inner diameter of the ground electrode is less than the inner diameter of the small-inner diameter portion of the housing.

5. The spark plug as set forth in claim 1, wherein the ground electrode includes an annular base member and a noble metal layer provided on an inner circumferential surface of the base member.

6. The spark plug as set forth in claim 5, wherein the noble metal layer is diffusion-bonded to the base member of the ground electrode.

7. The spark plug as set forth in claim 1, wherein the ground electrode has at least one groove that is formed in the inner circumferential surface of the ground electrode along an axial direction of the spark plug.

8. The spark plug as set forth in claim 1, wherein the housing has an inner shoulder formed on an inner periphery thereof, and the insulator has an outer shoulder formed on an outer periphery thereof, the insulator is retained in the housing with the outer shoulder of the insulator engaging with the inner shoulder of the housing in an axial direction of the spark plug, the housing also has a reduced-inner diameter portion which extends from the inner shoulder to the small-inner diameter portion of the housing and whose inner diameter is reduced in a distalward direction, and the insulator also has a reduced-outer diameter portion which extends from the outer shoulder to a distal end of the insulator and whose outer diameter is reduced in the distalward direction.

9. The spark plug as set forth in claim 8, wherein both the reduced-inner diameter portion of the housing and the reduced-outer diameter portion of the insulator are tapered distalward.

10. The spark plug as set forth in claim 9, wherein the outer diameter of the ground electrode is greater than an inner diameter of the reduced-inner diameter portion of the housing at a distal end of the reduced-inner diameter portion.

11. The spark plug as set forth in claim 10, wherein the difference between the outer diameter of the ground electrode and the inner diameter of the reduced-inner diameter portion of the housing at the distal end of the reduced-inner diameter portion is less than or equal to 7 mm.

12. The spark plug as set forth in claim 1, wherein at least one ventilation path is provided between the ground electrode and the small-inner diameter portion of the housing so as to fluidically connect an internal space of the ground electrode to an external space of the ground electrode.

13. The spark plug as set forth in claim 12, wherein the ventilation path is constituted of a ventilation groove that is:

formed in the distal end surface of the small-inner diameter portion of the housing so as to extend from an inner circumferential edge of the distal end surface of the small-inner diameter portion radially outward beyond a radially outer periphery of the ground electrode; and partially covered by the ground electrode from the distal side.

14. A method of manufacturing the spark plug as set forth in claim 1, the method comprising the steps of:

assembling the insulator and the center electrode into the housing so that the distal end portion of the center electrode extends through an internal space of the small-inner diameter portion of the housing; and joining the ground electrode to the distal end surface of the small-inner diameter portion of the housing, wherein in the joining step, the spark gap between the annular inner circumferential surface of the ground electrode and the annular outer circumferential surface of the distal end portion of the center electrode is adjusted and then the ground electrode is joined to the distal end surface of the small-inner diameter portion of the housing.

15. A spark plug for an internal combustion engine, the spark plug comprising:

a tubular housing;

a tubular insulator retained in the housing;

a center electrode secured in the insulator with a distal end portion of the center electrode protruding outside the insulator; and an annular ground electrode and fixed to a distal end of the housing, wherein the housing has, at the distal end thereof, a small-inner diameter portion that has a smaller inner diameter than other portions of the housing, the ground electrode is arranged on a distal end surface of the small-inner diameter portion of the housing so that: the ground electrode protrudes distalward from the distal end surface of the small-inner diameter portion of the housing; and an inner circumferential surface of the ground electrode faces an outer circumferential surface of the distal end portion of the center electrode through a spark gap formed therebetween, an outer diameter of the ground electrode is less than an outer diameter of the distal end surface of the small-inner diameter portion of the housing, and the ground electrode has at least one groove that is formed in the inner circumferential surface of the ground electrode along an axial direction of the spark plug.

16. A spark plug for an internal combustion engine, the spark plug comprising:

a tubular housing;

a tubular insulator retained in the housing;

a center electrode secured in the insulator with a distal end portion of the center electrode protruding outside the insulator; and an annular ground electrode and fixed to a distal end of the housing, wherein the housing has, at the distal end thereof, a small-inner diameter portion that has a smaller inner diameter than other portions of the housing, the ground electrode is arranged on a distal end surface of the small-inner diameter portion of the housing so that: the ground electrode protrudes distalward from the distal end surface of the small-inner diameter portion of the housing; and an inner circumferential surface of the ground electrode faces an outer circumferential surface of the distal end portion of the center electrode through a spark gap formed therebetween, an outer diameter of the ground electrode is less than an outer diameter of the distal end surface of the small-inner diameter portion of the housing, at least one ventilation path is provided between the ground electrode and the small-inner diameter portion of the housing so as to fluidically connect an internal space of the ground electrode to an external space of the ground electrode, and the ventilation path is constituted of a ventilation groove that is:

formed in the distal end surface of the small-inner diameter portion of the housing so as to extend from an inner circumferential edge of the distal end surface of the small-inner diameter portion radially outward beyond a radially outer periphery of the ground electrode; and partially covered by the ground electrode from the distal side.

* * * * *